US006423460B1

(12) United States Patent
Drappel et al.

(10) Patent No.: US 6,423,460 B1
(45) **Date of Patent: *Jul. 23, 2002**

(54) CONDUCTIVE COATED CARRIERS

(75) Inventors: Stephan V. Drappel, Toronto (CA); Daniel A. Foucher, Rochester, NY (US); Richard P. N. Veregin, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/885,569

(22) Filed: Jun. 20, 2001

(51) Int. Cl.[7] ..... G03G 9/113
(52) U.S. Cl. ..... 430/111.32; 430/111.35; 430/137.13
(58) Field of Search ..... 430/111.32, 111.35

(56) References Cited

U.S. PATENT DOCUMENTS 4,233,387 A 11/1980 Mammino et al. ..... 430/137
4,810,611 A 3/1989 Ziolo et al. ..... 430/106.6
4,935,326 A 6/1990 Creatura et al. ..... 430/108
4,937,166 A 6/1990 Creatura et al. ..... 430/108
5,935,750 A 8/1999 Barbetta et al. ..... 430/106.6
5,945,244 A 8/1999 Barbetta et al. ..... 430/106.6
5,977,241 A * 11/1999 Koloski et al. ..... 524/502
6,004,712 A 12/1999 Barbetta et al. ..... 430/108
6,010,812 A 1/2000 Barbetta et al. ..... 430/106.6
6,037,091 A * 3/2000 MacLeod et al. ..... 430/106.6
6,042,981 A 3/2000 Barbetta et al. ..... 430/106.6

OTHER PUBLICATIONS

Copending application U.S. Ser. No. 09/640,457, filed Aug. 17, 2000, on Coated Carriers.

* cited by examiner

*Primary Examiner*—John Goodrow
(74) *Attorney, Agent, or Firm*—E. O. Palazzo

(57) ABSTRACT

A carrier comprised of a core and thereover a polymer, and which polymer contains dispersed therein a mixture of an inorganic polymer, and an organic metallic polymer.

31 Claims, No Drawings

CONDUCTIVE COATED CARRIERS

COPENDING APPLICATIONS AND PATENTS

Illustrated in U.S. Ser. No. 09/885,571, the disclosure of which is totally incorporated herein by reference, filed concurrently herewith, is a carrier comprised of a core, and thereover a polymer blend comprised of an inorganic polymer and an organometallic polymer.

Illustrated in U.S. Pat. No. 5,945,244, U.S. Pat. No. 6,042,981, U.S. Pat. No. 6,010,812, U.S. Pat. No. 5,935,750, and U.S. Pat. No. 6,004,712, the disclosures of each being totally incorporated herein by reference, are carrier particles comprised, for example, of a core with a coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in U.S. Pat. No. 6,042,981 a carrier composition comprised of a core and thereover a polymer of polystyrene/alkyl methacrylate/dialkylaminoethyl methacrylate, polystyrene/alkyl methacrylate/alkyl hydrogen aminoethyl methacrylate, polystyrene/alkyl acrylate/dialkylaminoethyl methacrylate, or polystyrene/alkyl acrylate/alkyl hydrogen aminoethyl methacrylate; in U.S. Pat. No. 6,010,812 a carrier comprised of a core and a polymer coating of styrene/monoalkylaminoalkyl methacrylate or styrene/dialkylaminoalkyl methacrylate; in U.S. Pat. No. 6,004,712 a carrier comprised of a core and thereover a polymer of methylmethacrylate and a monoalkyl aminoalkyl methacrylate, or a polymer of methylmethacrylate and dialkylaminoalkyl methacrylate, and in U.S. Pat. No. 5,935,750 a carrier comprised of a core and a polymer coating containing a quaternary ammonium salt functionality.

In copending application U.S. Ser. No. 784,633, the disclosure of which is totally incorporated herein by reference, there is disclosed a polymerization process for the preparation of toner polymers and wherein there is selected for the process a transition metal catalyst, such as ferrocene, ferrocenium salts, and more specifically 1,1-dicyano-2-ferrocenylethene.

Illustrated in U.S. Pat. Ser. No. 6,358,659, the disclosure of which is totally incorporated herein by reference, is a carrier comprised of a core and thereover a polymer or mixture of polymers, and wherein the polymer contains a conductive inorganic polymer dispersed therein.

Illustrated in U.S. Pat. No. 6,358,659, the disclosure of which is totally incorporated herein by reference, is a carrier comprised of a core and thereover a polymer or mixture of polymers, and wherein the polymer contains a conductive inorganic polymer dispersed therein.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with conductive coated carrier components, or coated carrier particles that can be prepared by, for example, dry powder processes. More specifically, the present invention relates to compositions, especially carrier compositions comprised of a core, and thereover a blend or mixture of polymers comprised of an organic, like an organometallic containing polymer, or polymers, an inorganic polymer or inorganic polymers and further polymers, that is, for example, a plurality of polymers, such as 1 to about 10, and more specifically, from about 1 to about 3. Also, in embodiments the present invention relates to compositions, especially carrier compositions comprised of a core, and thereover a polymer, or polymers and dispersed therein a conductive component. Accordingly in aspects of the present invention there are provided carriers comprised of a core, a polymer coating, such as polymethylmethacrylate, and as a conductive additive dispersed therein an inorganic metallic polymer, an organic metallic polymer, or mixtures thereof. The inorganic and organic metallic polymers may contain conductive pendant groups thereon and thus the use of a separate conductive component, such as carbon black, can be avoided in embodiments of the present invention.

In embodiments of the present invention, the carrier particles are comprised of a core with a coating blend thereover, such as an organometallic ferrocene containing polymer such as a poly(ferrocenyl silane), a poly(ferrocenyl phosphane), or more specifically, poly(ferrocenyl dialkyl silane), such as dimethylsilane or poly(ferrocenyl aryl, such as ferrocenyl phenylphosphane), and an inorganic polymer of, for example, a polysiloxane containing conductive pendant groups, a polyphosphazene of poly(bis (methoxyethoxyethoxy) phosphazene of (1), poly(phenyl (methoxy ethoxyethoxy) phosphazene (2); poly(methyl (methoxy ethoxyethoxy) phosphazene (3); poly(methoxy (methoxyethoxyethoxy) phosphazene (4); poly(phenoxy (methoxyethoxy ethoxy)phosphazene (5); poly (methylamino (methoxyethoxyethoxy) phosphazene (6); poly(phenylamino (methoxyethoxyethoxy) phosphazene (7); poly(bis(methoxyethoxy) phosphazene (8); poly(bis (methoxypropoxy) phosphazene (9); poly(bis-β-pentafluroethylpropoxy)phosphazene (10); poly (bisphenoxy)phosphazene (11); poly(bis-β-trifluoromethylethoxy) phosphazene (1 2); poly(bis-4-phenylphenoxy) phosphazene (13); poly(bis[1,1]biphenyl-4-methoxy-4'-ethoxyethoxyethoxy) phosphazene (14); or poly(bismethoxy) phosphazene (15); a carrier wherein the conductive polymer is a polyphosphazene of poly[bis-4-isopropylphenoxy)phosphazene] (16); poly(2-methoxyethoxy ethoxycarbo-4,4-methoxyethoxyethoxy-6,6-methoxyethoxyethoxy) phosphazene (17); poly(2-methoxyethoxyethoxy-thio-4,4-methoxy ethoxyethoxy-6,6-methoxy ethoxyethoxy) phosphazene (18); poly(2-methoxyethoxyethoxy-4,4-methoxyethoxyethoxy-6,6-methoxy ethoxyethoxy) phosphazene (19); or (poly (methoxyethoxyethoxy) oxothiazene (20); poly[(2-(2-(2-methoxyethoxy)ethoxy)-ethoxy)propyl alkyl siloxane] (21); poly[methyl(2-(2-(2-methoxyethoxy) ethoxy)-ethoxy) propyl alkyl siloxane] (22); poly[ethyl(2-(2-(2-methoxyethoxy)ethoxy)-ethoxy)propyl alkyl siloxane] (23); poly[propyl(2-(2-(2-methoxyethoxy)ethoxy)-ethoxy)propyl alkyl siloxane] (24); poly[phenyl(2-(2-(2-methoxyethoxy) ethoxy)-ethoxy)propyl alkyl siloxane] (25); or poly[methyl (2-(2-(2-methoxyethoxy)ethoxy)-ethoxy)-ethoxy)-ethoxy)-ethoxy)-ethoxy) propyl alkyl siloxane] (26); a carrier wherein the inorganic conductive polymer possesses an $M_w$ weight average molecular weight of from about 5,000 to about 1,000,000, and of an $M_n$ number average molecular weight of from about 12,000 to about 1,000,000; a carrier wherein the inorganic polymer coating weight thereof is from about 0.1 to about 20 weight percent, or wherein the organic and/or organometallic polymer coating weight is from about 1 to about 3 weight percent; a carrier wherein the organic and/or organometallic polymer possesses a glass transition temperature Tg of from about 120° C. to about 200° C., or wherein the organic and/or organometallic polymer Tg is from about 60° C. to about 80° C.; and the like. Also, in embodiments there are provided carriers wherein the polymers selected can be conductive and thus there is avoided the need to add to the polymer a conductive component such as carbon black. The carrier may in embodiments of the present invention include a polymer coating blend of an organic and an inorganic polymer thereover in admixture with other suitable polymers, and more specifically, with a further polymer, such as a fluoropolymer, polymethylmethacrylate, poly(urethane), especially a crosslinked polyurethane, such as a poly (urethane)polyester and the like, and moreover, the copolymer coating may contain a conductive component, such as carbon black, and which conductive component may be dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like.

Advantages associated with the carriers of the present invention, especially with the polymer blend coating thereover, include a high triboelectrical charge, for example a carrier tribo of from about a plus (positive charge) or negative charge of about 10 to about 70, and more specifically, from about 15 to about 50 microcoulombs per gram, and yet more specifically, from about 15 to about 40 microcoulombs per gram and which carriers possess a conductivity of, for example, from about $10^{-6}$ to about $10^{-13}$, and more specifically, from about $10^{-8}$ to about $10^{-11}$ and which conductivity is measured by a magnetic brush conducting cell; a reduction in the threshold for the onset of electrical conductivity; tunable conductivity levels, substantially constant carrier conductivity values; excellent adhesion of the coating blend to the carrier core; substantially no affect on the triboelectric properties of the coating polymer like polymethylmethacrylate when this polymer is contained in the blend; high robust carrier tribo charge of a positive value, high toner tribo charge of a negative value, excellent admix, for example from about 1 to about 30 seconds as determined in the charge spectrograph, increased resistance of the carrier and a decreased sensitivity of the carrier triboelectric value to the relative humidity of the environment. The tribo can be determined by a number of known methods, such as the use of a Faraday Cage. With respect to high toner tribo charge of a negative value, this property is of value to xerographic, especially color xerographic applications, primarily because there is enabled development of toner particles into regions of the imaging member, such as a photoreceptor where strong fringe electrical fields exist, that is, at the borders of solids areas and lines. Developing toner particles through these fringe fields minimizes or can eliminate the untoned part of the image which appears between two adjacent colors in an image.

There can be enabled with the present invention in embodiments carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. A specific advantage associated with the carriers of the present invention include robust, extended life carriers, with lifetimes, for example, of 1,000,000 imaging cycles, a high triboelectrical charge, for example a carrier tribo range of from about a plus (positive charge) 25 to about 100, and more specifically, from about a positive 25 to about a positive 55 microcoulombs per gram, and most specifically, from about a positive 30 to about a positive 50 microcoulombs per gram. The carrier particles of the present invention can be selected for a number of different imaging systems and devices, such as xerographic copiers and printers, inclusive of high speed color xerographic systems, printers, digital systems, such as the Xerox Corporation 1090 Marathon, Document Centre 265, the DocuTech series, DocuColor 40, and the like, and wherein monochrome or colored images with excellent and substantially no background deposits are achievable.

The carrier particles of the present invention can be selected for a number of different imaging systems and devices, such as copiers and printers, inclusive of high speed color xerographic systems, printers, digital systems, multitask imaging and printing, and wherein colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

PRIOR ART

The electrostatographic process, and particularly the xerographic process, is well known. This process involves the formation of an electrostatic latent image on a photoreceptor, followed by development and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions are the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there are disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of about 20 minutes to about 120 minutes enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof. The carriers of the present invention are advantageous over this prior art in that there can be enabled high positive triboelectric charge on the carrier particles, up to about a 150 negative triboelectric charge is imparted to the toner particles developed onto a photoreceptor in, for example, a xerographic development environment. Further, the full range of electrical properties of the carrier particles can be achieved at high triboelectric charging values, from carrier conductivities of about $10^{-17}$ mho/cm to about $10^{-6}$ mho/cm, that is, from the insulative to the conductive regime, and the carrier triboelectric charge and carrier conductivity can be varied and preselected.

With further reference to the prior art, carriers obtained by applying insulating resinous coatings to porous metallic carrier cores using solution-coating techniques are undesirable from many viewpoints. For example, the coating may not reside primarily; and therefore, may not be fully available for triboelectric charging when the coated carrier particles are mixed with finely divided toner particles. Also, solution coated carrier particles, when combined and mixed with finely divided toner particles, provide in some instances triboelectric charging values which are too low for many uses.

When resin coated carrier particles are prepared by powder coating process, the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, more specifically from about $10^{-10}$ (ohm-cm)$^{-1}$ to about $10^{-6}$ (ohm-cm)$^{-1}$, and most specifically from about $10^{-8}$ (ohm-cm)$^{-1}$ to about $10^{-6}$ (ohm-cm)$^{-1}$, and high carrier triboelectric charging values of from about 20 to about 150, and, for example, from a positive about 45 to a positive about 90 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles.

Other U.S. Pat. Nos. that may be of interest include 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with conductive carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values, and wherein the carrier includes thereover an organometallic ferrocene containing polymer and an inorganic polymer blend, or alternatively an organometallic ferrocene/inorganic polysiloxane copolymer and a coating of a polymer of a copolymer of polymethylmethacrylate, and poly (urethane), and wherein the coating may contain therein a conductive component of, for example, carbon black.

Aspects of the present invention relate to a carrier comprised of a core and thereover a polymer, and which polymer contains dispersed therein an inorganic polymer, and an organic metallic polymer; a carrier comprised of a core and thereover a polymer, and which polymer contains dispersed therein as a conductive additive an inorganic metallic polymer; a carrier comprised of a core and thereover a polymer, and which polymer contains dispersed therein as a conductive additive an organic metallic polymer; a developer comprised of a (1) carrier core, thereover a polymer or polymers layer; (2) dispersed therein as a conductive additive an inorganic polymer, or an organic metallic polymer, and (3) a toner; a carrier comprised of a core and thereover a polymer or polymers, and dispersed therein, or contained therein as a conductive additive an inorganic metallic polymer, an organic metallic polymer, and mixtures thereof, and an optional additional polymer coating or polymers, for example from 1 to about 5 further polymers, wherein the polymer coating possesses an $M_w$ of from about 20,000 to about 900,000, or greater than about 1,000,000, for example about 1,000,000 to about 3,000,000, and of an $M_n$ of from about 12,000 to about 350,000, or greater than about 1,000,000, for example about 1,000,000 to about 3,000,000; a carrier comprised of a core and thereover a ferrocene containing polymer blend; a carrier wherein the ferrocene containing polymer in the blend is poly(ferrocenyl dimethylsilane), poly(ferrocenyl phenylphosphane), or mixtures thereof; a carrier wherein the ferrocene is a ferrocenylsilane, a mixture of poly(ferrocenyl dimethylsilane) and poly(ferrocenyl phenylphosphane), or a mixture of poly(ferrocenyl dimethylsilane), poly(ferrocenyl phenylphosphane), and poly(ferrocenyl dimethylgermane); a carrier wherein the polymer mixture coating possesses an $M_w$ of from about 10 to about $10^7$ and an $M_n$ of from about $10^5$ to about $10^7$; a carrier wherein the polymer mixture coating weight is from about 0.1 to about 20 weight percent; a carrier wherein the polymer mixture coating weight is from about 1 to about 3 weight percent; a carrier wherein the polymer mixture coating contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide; a carrier with a triboelectric charge of from about 15 to about 30 microcoulombs per gram; a developer comprised of the carrier illustrated herein and toner; a developer comprised of carrier with a coating of a blend of polymers, and a toner comprised of thermoplastic resin and colorant; a developer wherein the colorant is a pigment and the toner resin is a styrene copolymer, or a polyester; a carrier comprised of a core and thereover a polymer or mixture of polymers, and wherein the polymer contains a conductive inorganic polymer dispersed therein; a carrier comprised of a core and an inorganic conductive polymer; a carrier wherein the conductive polymer is a polyphosphazene; a carrier wherein the conductive polymer is a polymetallonitrile; a carrier wherein the conductive polymer is a polysiloxane containing conductive pendant groups; a carrier wherein the conductive polymer is a polyphosphazene of poly(bis(methoxyethoxyethoxy) phosphazene (1); poly(phenyl(methoxy .ethoxyethoxy) phosphazene (2); poly(methyl(methoxy ethoxyethoxy) phosphazene (3); poly(methoxy (methoxyethoxyethoxy) phosphazene (4); poly(phenoxy(methoxyethoxy ethoxy) phosphazene (5); poly(methylamino (methoxyethoxyethoxy) phosphazene (6); poly (phenylamino (methoxyethoxyethoxy) phosphazene (7); poly(bis(methoxyethoxy) phosphazene (8); poly(bis (methoxypropoxy) phosphazene (9); poly(bis-β-pentafluroethylpropoxy)phosphazene (10); poly (bisphenoxy) phosphazene (11); poly(bis-β-trifluoromethylethoxy) phosphazene (12); poly(bis-4-phenylphenoxy) phosphazene (13); poly(bis[1,1]biphenyl-4-methoxy-4'-ethoxyethoxyethoxy) phosphazene (14); poly (bismethoxy) phosphazene (15); poly[bis-4-isopropylphenoxy)phosphazene] (16); poly(2-methoxyethoxy ethoxycarbo-4,4-methoxyethoxyethoxy-6,6-methoxyethoxyethoxy) phosphazene (17); poly(2-methoxyethoxyethoxy-thio-4,4-methoxy ethoxyethoxy-6,6-methoxy ethoxyethoxy) phosphazene (18); poly(2-methoxyethoxyethoxy-4,4-methoxyethoxyethoxy-6,6-methoxy ethoxyethoxy) phosphazene (19); (poly (methoxyethoxyethoxy)oxothiazene (20), and the like; a carrier wherein the conductive polymer is a polysiloxane of poly[(2-(2-(2-methoxyethoxy)ethoxy)-ethoxy)propyl alkyl siloxane] (21); poly[methyl(2-(2-(2-methoxyethoxy) ethoxy)-ethoxy)propyl alkyl siloxane] (22); poly[ethyl(2-(2-(2-methoxyethoxy)ethoxy)-ethoxy)propyl alkyl siloxane] (23); poly[propyl(2-(2-(2-methoxyethoxy)ethoxy)-ethoxy) propyl alkyl siloxane] (24); poly[phenyl(2-(2-(2-methoxyethoxy)ethoxy)-ethoxy)propyl alkyl siloxane] (25); or poly[methyl(2-(2-(2-methoxyethoxy)ethoxy)-ethoxy)-ethoxy)-ethoxy)-ethoxy)-ethoxy) propyl alkyl siloxane] (26); a carrier wherein the conductive polymer possesses an $M_w$ weight average molecular weight of from about 5,000 to about 1,000,000, and of an $M_n$ number average molecular weight of from about 12,000 to about 1,000,000; a developer wherein the carrier core is selected from the group consisting of iron, ferrites, steel and nickel; a developer with a carrier triboelectric charge of from about a positive 15 to about a positive 50 microcoulombs per gram, and a toner triboelectric charge of from about a negative 15 to about a negative 50 microcoulombs per gram; a developer with a carrier triboelectric charge of from about a negative 15 to about a negative 50 microcoulombs per gram, and a toner triboelectric charge of from about a positive 15 to about a positive 50 microcoulombs per gram; a carrier wherein there is included as a coating together with the polymer blend a further polymer of a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate; a carrier wherein the carrier contains a second or further additional polymer coating; a carrier wherein the second or added further coating is comprised of a styrene acrylate, a styrene methacrylate, or a fluoropolymer; a carrier wherein the second coating is comprised of a polyurethane; a carrier wherein the second coating is comprised of a polyurethane/polyester; an imaging process which comprises developing an image with the developer illustrated herein; a process for the preparation of the carrier illustrated herein by the dry mixing and heating of the core and the coating; a carrier wherein the organometallic ferrocene polymer is of the formula $$Fc—Si(RR')$$

wherein Fc is ferrocene, and R and R' are each alkyl, or aryl; a carrier wherein the ferrocene polymer is of the formula FcPR wherein Fc is ferrocene, P is phosphorous, and R is alkyl or aryl; a carrier wherein the ferrocene polymer is poly(ferrocenyl dimethyl silane), poly(ferrocenyl di-n-hexyl silane), poly(ferrocenyl phenyl phosphone), or mixtures thereof; a carrier comprised of a core and thereover a ferrocene containing polymer inclusive of polymers of ferrocenes, ferrocenyl silanes, ferrocenyl germanes, ferrocenyl phosphanes, ferrocenyl phosphane sulfides, ferrocenyl sulfides, polyferrocenyl alkenes, and ferrocenyl persulfides, vinylferrocene, copolymers, such as poly(arylene-siloxane-ferrocene), polyferrocene copolymers with dimethylsiloxane or with -(methylphenylsilane)$_n$ oligomers, where n is a number, such as 1 to about 10, and ferrocene containing polyesters. Also suitable are the above polymers with alkyl, aryl, alkoxy, aryloxy, hydroxyl, aceto, amino, phenyl, sulfonate, phosphonate, nitro, and ferrocenyl substituents.

Examples of carrier coatings including ferrocene coatings are

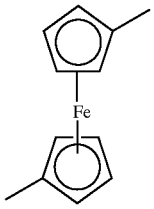
1
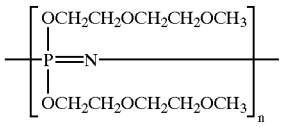
2
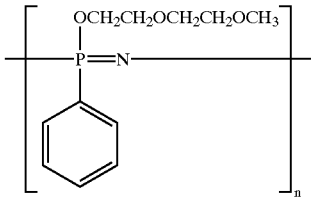
3
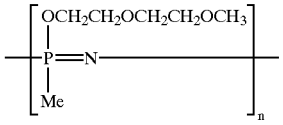
4
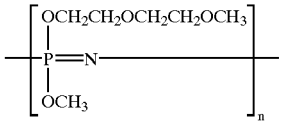
5
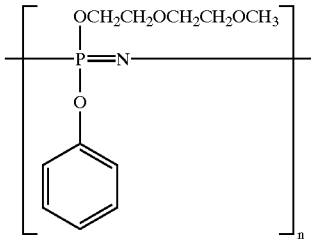
6
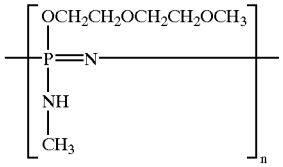
7
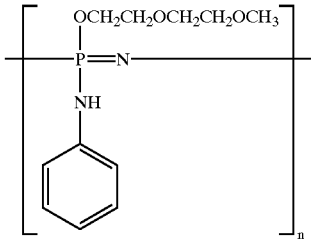
8
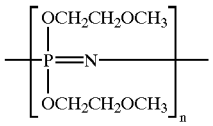
-continued
9
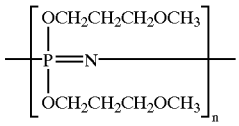
10
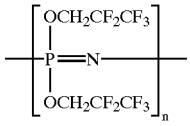
11
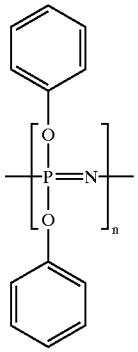
12
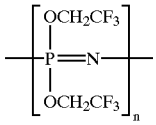
13
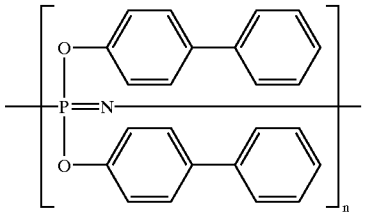
14
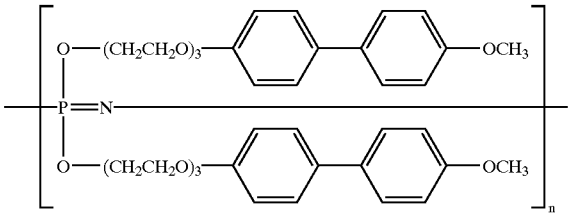
15
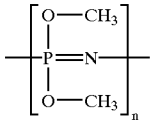
16
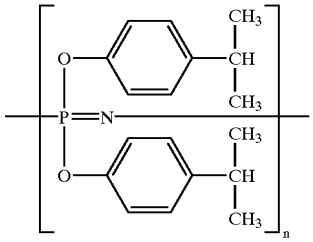

-continued

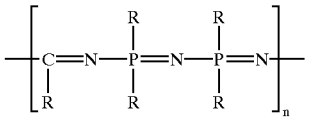

where R = $(OCH_2CH_2)_2OCH_3$

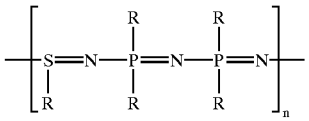

where R = $(OCH_2CH_2)_2OCH_3$

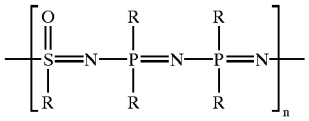

where R = $(OCH_2CH_2)_2OCH_3$

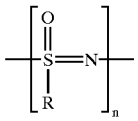

where R = $(OCH_2CH_2)_2OCH_3$

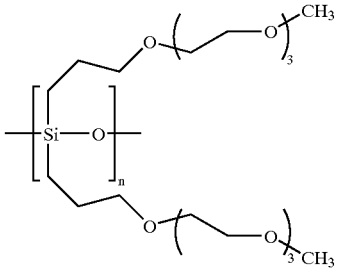

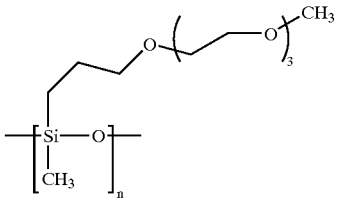

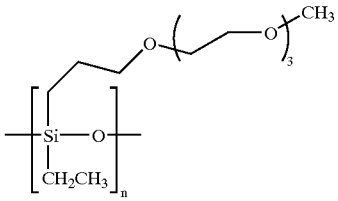

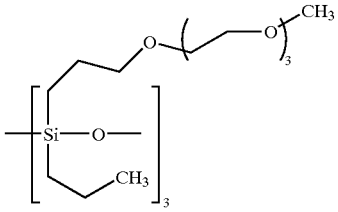

-continued

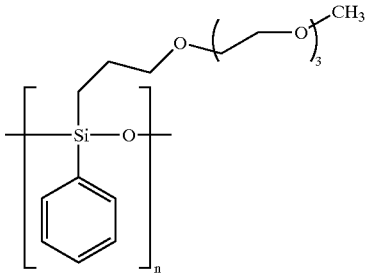

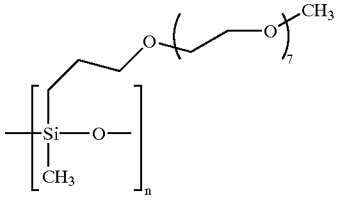

and generally wherein R and R' may be an alkyl, or aryl, a ferrocenyl substituent, such as —[Fc—$Si(CH_3)_2$]—, poly (ferrocenyl phosphanes), —[Fc—P(R)]— where Fc=ferrocene; R may be an alkyl or aryl substituent, such as poly(ferrocenyl phenylphosphane), —[Fc—P(phenyl)]—; block copolymers, such as —[Fc—$Si(CH_3)_2]_m$—[$Si(CH_3)_2O]_n$—, and random copolymers of —[Fc—$Si(CH_3)_2$]—[$Si(CH_3)_2O]_4$—; and wherein n represents the number of segments, and can be, for example, a number to provide a polymer with the $M_w$ and $M_n$ indicated herein.

The present invention is also directed to, for example, developer compositions comprised of toner particles, and carrier particles prepared, for example, by a powder coating process, and wherein the carrier particles are comprised of a core containing a polymer blend coating thereover; carrier particles prepared by mixing low density porous magnetic, or magnetically attractable metal core carrier particles with from, for example, between about 0.05 percent and about 3 percent by weight, based on the weight of the coated carrier particles, of a polymer blend, and which polymer blend may optionally contain dispersed therein carbon black or a similar conductive component, until adherence thereof to the carrier core by mechanical impaction or electrostatic attraction; heating the resulting mixture of carrier core particles and polymer blend to a temperature, for example, of between from about 200° F. to about 650° F., and more specifically, from about 350° F. to 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Examples of inorganic polymers are polyphosphazenes of poly(bis(methoxyethoxyethoxy) phosphazene (1); poly (phenyl(methoxy ethoxyethoxy)phosphazene (2); poly (methyl(methoxy ethoxyethoxy) phosphazene (3); poly (methoxy (methoxyethoxyethoxy) phosphazene (4); poly (phenoxy(methoxyethoxy ethoxy) phosphazene (5); poly (methylamino (methoxyethoxyethoxy) phosphazene (6); poly(phenylamino (methoxyethoxyethoxy) phosphazene (7); poly(bis(methoxyethoxy) phosphazene (8); poly(bis (methoxypropoxy) phosphazene (9); poly(bis-β-pentafluroethylpropoxy) phosphazene (10); poly (bisphenoxy)phosphazene (11); poly(bis-β-trifluoromethylethoxy) phosphazene (12); poly(bis-4-phenylphenoxy) phosphazene (13); poly(bis[1,1]biphenyl-4-methoxy-4'-ethoxyethoxyethoxy)phosphazene (14); or poly(bismethoxy)phosphazene (15); a carrier wherein the conductive polymer is a polyphosphazene of poly[bis-4-isopropylphenoxy)phosphazene] (16); poly(2-methoxyethoxy ethoxycarbo-4,4-methoxyethoxyethoxy-6,6-methoxyethoxyethoxy) phosphazene (17); poly(2-methoxyethoxyethoxy-thio-4,4-methoxy ethoxyethoxy-6,6-methoxy ethoxyethoxy) phosphazene (18); poly(2-methoxyethoxyethoxy-4,4-methoxyethoxyethoxy-6,6-methoxy ethoxyethoxy) phosphazene (19); or (poly (methoxyethoxyethoxy)oxothiazene (20) with examples of the conductive polymers being a polysiloxane of poly[(2-(2-(2-methoxyethoxy)ethoxy)-ethoxy)propyl alkyl siloxane] (21); poly[methyl(2-(2-(2-methoxyethoxy) ethoxy)-ethoxy) propyl alkyl siloxane] (22); poly[ethyl(2-(2-(2-methoxyethoxy)ethoxy)-ethoxy)propyl alkyl siloxane] (23); poly[propyl(2-(2-(2-methoxyethoxy)ethoxy)-ethoxy)propyl alkyl siloxane] (24); poly[phenyl(2-(2-(2-methoxyethoxy) ethoxy)-ethoxy)propyl alkyl siloxane] (25); or poly[methyl ((2-(2-(2-methoxyethoxy)ethoxy)-ethoxy)-ethoxy)-ethoxy)-ethoxy)-ethoxy) propyl alkyl siloxane]; and wherein the conductive polymer possesses an $M_w$ weight average molecular weight of from about 5,000 to about 1,000,000, and of an $M_n$ number average molecular weight of from, for example, about 12,000 to about 1,000,000.

Examples of added organic polymers and copolymers are polystyrene, polyacrylate, polymethacrylate, polyaminomethylacrylate, polystyrene/alkyl methacrylate/dialkylaminoethyl methacrylate, polystyrene/alkyl methacrylate/alkyl hydrogen aminoethyl methacrylate, polystyrene/alkyl acrylate/dialkylaminoethyl methacrylate, or polystyrene/alkyl acrylate/alkyl hydrogen aminoethyl methacrylate.

Examples of organometallic polymers contained in the blend in an amount, for example, of from about 0.1 to about 15 weight percent, and wherein the blend contains a suitable amount of the inorganic polymer to arrive at a total of about 100 percent are, poly(ferrocenyldimethylsilane), poly (ferrocenyl-n-hexylsilane), poly (ferrocenylmethylphenylsilane), poly (ferrocenyidimethylgermane), poly (ferrocenylphenylphospene), poly (ferrocenylphenylphosphane sulfide), poly (ferrocenylethane), poly(ferrocenyldisulfide), poly (ferrocene), poly(vinylferrocene, ferrocene containing polymers, where Fc is a ferrocene moiety like poly (ferrocenyl dimethylsilane), —[Fc—$Si(CH_3)_2]_n$— with an $M_w$ of greater than about $>10^5$, available from Professor Ian Manners, Department of Chemistry, University of Toronto; poly(ferrocenyl di-n-hexylsilane), —[Fc—$Si(CH_2)_5CH_3)_2]_n$—; poly(ferrocenyl phenylphosphane), —[Fc—P (phenyl)]$_n$-— available from Professor Ian Manners, Department of Chemistry, University of Toronto; and blends thereof, such as a 70:30 weight percent blend of poly (ferrocenyl dimethylsilane) with poly(ferrocenyl phenylphosphane), available from Professor Ian Manners, Department of Chemistry, University of Toronto, —[Fc—$Ge(CH_3)_2]_n$—, —[Fc—$Ge(CH_2CH_3)_2]_n$—, —[Fc—Ge $(CH_2CH_2CH_2CH_3)_2]_n$—, —[Fc—Ge(phenyl)$_2]_n$—, and —[Fc]$_n$— wherein n represents the number of segments, and organometallic/inorganic copolymers including ferrocene-siloxane containing polymers, where Fc represents the ferrocene moiety in poly(ferrocenyl dimethylsilane)-co-poly (dimethylsiloxane), —[Fc—$Si(CH_3)_2]_n$—$(Me_2SiO)_m$ with an $M_n$ and $M_w$ or greater than about $>10^5$, and available from Professor Ian Manners, Department of Chemistry, University of Toronto; poly(ferrocenyl di-n-hexylsilane), —[Fc—$Si(CH_2)_5CH_3)_2]_n$—$(Me_2SiO)_m$; poly(ferrocenyl phenylphosphane), —[Fc—P(phenyl)]$_n$—$(Me_2SiO)_m$, poly (ferrocenyl dimethylgermane)-co-poly(dimethylsiloxane)-[Fc—$Ge(CH_3)_2]_n$—, available from Professor Ian Manners, Department of Chemistry, University of Toronto, wherein m and n represent the number of segments; and related materials, blends and combinations thereof. The polymer coating weight is, for example, from about 0.3 weight percent to about 10 weight percent, and more specifically, from about 0.5 weight percent to about 5 weight percent.

In addition to the blend, further carrier coating polymer examples are, for example, a fluorocarbon, polymethylmethacrylate (PMMA), a thermosetting polymer, such as a thermosetting polyurethane, a polyester, a styrene based polymer, or second a nitrogen-containing copolymer, and wherein the first polymer is selected in an amount of from about 1 to about 100, or from about 10 to about 75 weight percent, based on the total weights of all polymers and conductive components optionally present in the carrier, and the second polymer is selected in an amount of from about 99 to about 0, or from about 90 to about 25 weight percent, based on the total weights of all polymers and conductive components present in the carrier; and wherein the carrier core is a metal, a ferrite, a metal oxide, and the like, inclusive of known carrier cores.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of importance with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide, available from D.M. Steward Corporation or Powdertech Corporation, Ni/Zn-ferrite available from Powdertech Corporation, Sr (strontium)-ferrite containing, for example, about 14 percent strontium oxide and 86 percent iron oxide, available from Powdertech Corporation Ba-ferrite, magnetites, available, for example, from Hoeganaes Corporation (Sweden), nickel, mixtures thereof, and the like. More specific carrier cores include ferrites, and sponge iron, or steel grit with an average particle size diameter of, for example, from between about 30 microns to about 400 microns, and more specifically, from about 50 to about 50 microns.

Examples of additional polymers selected for the carrier include copolymers of methylmethacrylate or methylacrylate and a monoalkyl, or dialkyl amine, such as a dimethylaminoethyl methacrylate, diethylaminoethyl methacrylate, diisopropylaminoethyl methacrylate, or t-butylaminoethyl methacrylate; and the like. Specific examples of copolymer coatings are poly(methylmethacrylate/dimethylaminoethyl methacrylate), poly(methylmethacrylate/tertiary-butylaminoethyl methacrylate), poly(methyl methacrylate/diethylaminoethyl methacrylate), poly(methylmethacrylate/diisopropylaminoethyl methacrylate), copolymers of methylmethacrylate with other monoalkyl or dialkylaminoethyl methacrylates, wherein alkyl contains, for example, from about 1 to about 25, and more specifically, from 1 to about 10 carbon atoms, such as methyl, ethyl, propyl, butyl, pentyl, hexyl, octyl, nonyl, and the like; polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 patents mentioned herein.

A specific additional polymer can be comprised of a thermosetting polymer and yet, more specifically, a poly (urethane) thermosetting resin which contains, for example, from about 75 to about 95, and more specifically, about 80 percent by weight of a polyester polymer, which when combined with an appropriate crosslinking agent, such as isopherone diisocyannate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first polymer, generally prior to mixing with the core, which when fused forms a uniform coating of the first and second polymers on the carrier surface. The second polymer is present, for example, in an amount of from about 0 percent to about 99 percent by weight, based on the total weight of the first and second polymers and the conductive component in the first polymer.

The carrier polymer blend coating optionally has dispersed therein in embodiments conductive components, such as metal oxides like tin oxide, conductive carbon blacks, and the like, in effective amounts of, for example, from about 0 to about 70 and more specifically, from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

Also, the carrier coating blend can have incorporated therein various known charge enhancing additives, such as quaternary ammonium salts, and more specifically, distearyl dimethyl ammonium methyl sulfate (DDAMS), bis[1-[(3,5-disubstituted-2-hydroxy phenyl)azo]-3-(mono-substituted)-2-naphthalenolato(2-)]chromate(1-), ammonium sodium and hydrogen (TRH), cetyl pyridinium chloride (CPC), FANAL PINK® D4830, silicas, silanes and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

The process for incorporating the polymer blend onto a carrier core can be sequential, a process in which one of polymers, when two polymers are selected, is fused to the surface in a first operation, and the second polymer is fused to the surface in a subsequent fusing operation. Alternatively, the process for incorporation can comprise a single fusing by heating the core and polymer blend coatings.

Examples of specific suitable processes selected to apply the polymer blend, or mixture of the polymer blend and a plurality of further polymers, for example from about 2 to about 5, and more specifically, two, of polymer coatings to the surface of the carrier particles include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties. The aforementioned conductivities can include various suitable values. Generally, however, this conductivity is from about $10^{-7}$ to about $10^{-17}$ mho-cm-$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and more specifically, pigments can be selected as the colorant for the toner particles including, for example, carbon black, nigrosine dye, lamp black, iron oxides, magnetites, and mixtures thereof, known cyan, magenta, yellow pigments, and dyes. The colorant, which is more specifically, carbon black, should be present in a sufficient amount to render the toner composition highly colored. Thus, the colorant can be present in amounts of, for example, from about 1 percent by weight to about 20, and more specifically, from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, Pigment Blue 15:3, and the like. Examples of cyans that may be used include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of known suitable dyes thereof can be selected. These colorants are generally present in the toner composition in an amount of from about 1 weight percent to about 15, and, for example, from about 2 to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and more specifically, in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner compositions can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and more specifically, from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

EXAMPLE I

Preparation of Polyferrocenylsilane and Polyferrocenyl-siloxane Copolymers

Ring-opening Polymerization Method

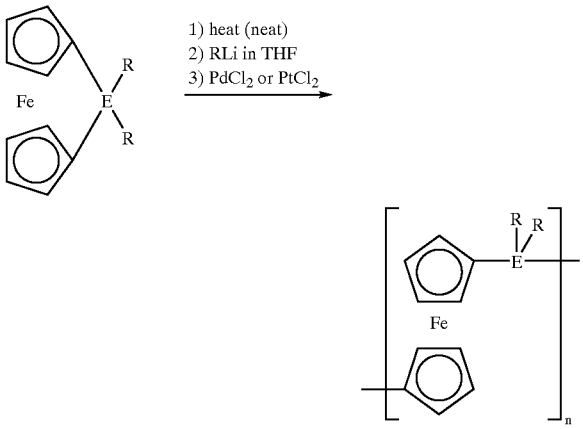

where

E=Si, Ge, P, B,

R=alkyl, aryl, alkoxyl, or halide n is the number of segments

RLi is an alkyl lithium

THF is tetrahydrofuran $PdCl_2$ or $PtCl_2$ is a catalyst.

Poly(ferrocenylsilanes) have been prepared by Dr. Ian Manners at the University of Toronto through either thermal, anionic, or metal catalyzed ring-opening polymerization of the corresponding strained ferrocenophanes. Polymerization under these conditions leads to controlled molecular weights of about $1\times10^3$ to about $1\times10^7$ daltons and polydispersities generally less than about 2.

Diblock, triblock or random copolymers can be prepared by anionic polymerization methods where initiation of either block or random segments can be used to polymerize additional siloxane or ferrocenophane monomers. In these carefully controlled polymerizations, a trace amount of anionic initiator, such as n-butyllithium, is used to ring-open the strained ring, creating a living end to which additional monomers can be added at a controlled rate.

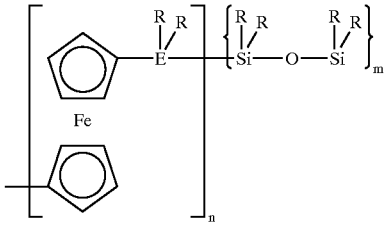

where

E=Si, Ge, P, B,

R=alkyl, aryl, alkoxyl, or halide n and m represent the number of segments.

SYNTHETIC EXAMPLE I

Preparation of Polyphosphazenes by Thermal Ring Opening and for use as Homopolymers, Blends or Additives in Carrier Coatings Polyphosphazenes containing alkyl, aryl, alkoxy, or aryloxy pendant groups are generally prepared from the polymeric intermediate polydichlorophosphazene which in turn can be readily prepared from the thermal ring-opening of hexachlorophosphazene or hexafluorocyclo triphosphazene at 250° C. A general synthetic procedure is as follows.

To a neat sample of hexachlorocyclotriphosphazene, 99 percent (100 grams, 0.402 mol) is added a small amount of a suitable Lewis acid initiator, such as $BCl_3$ (0.005 gram, $4\times10^{-4}$ mols) in a sealed ampoule that is heated to 250° C. for 3 to 4 hours or until the melt becomes immobile. The sealed ampoule is cooled, broken, and dissolved in 200 milliliters of dichloromethane. The resulting monomeric material is separated by precipitation into an excess of hexanes. The polymer resulting is recovered as a dry, hydroscopic powder that should not be exposed to air for long periods of time. The polymer is readily redissolved in solvents like dioxane and can be substituted, reference R, with the appropriate alkyl, aryl lithium or Grignard reagent, aryl or alkyl alkoxy metal salt, or a number of amino pendant groups.

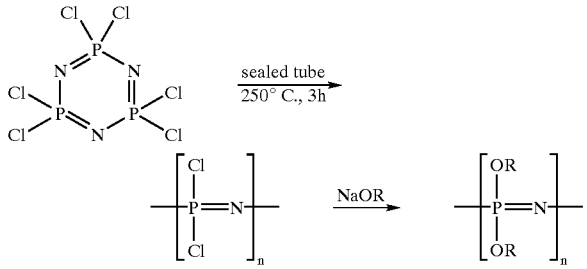

wherein n represents the number of segments.

SYNTHETIC EXAMPLE II

Room Temperature 25° C. Preparation of Polyphosphazenes for use as Homopolymers, Blends or Additives in Carrier Coatings from Lewis Acid Catalyzed Polymerization of Phosphoranimine Alternatively, the immediately above intermediate polymer can be prepared through a living cationic room temperature route involving the catalytic reaction of phosphorus pentachloride with trichloro(trimethylsilyl) phosphoranimine or related materials.

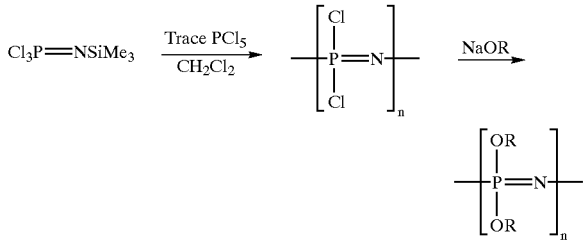

A mixture of freshly distilled phosphoranimine (50 grams, 0.223 mol) and a small amount of phosphorus pentachloride (250 milligrams, $1.2\times10^{-4}$ mols) are added to large glass ampoule and sealed under vacuum. The mixture is allowed to stand at room temperature for about 3 to about 4 days resulting in two phases with the elimination of chlorotrimethylsilane. The resulting solution is evaporated to dryness and redissolved in dioxane. The polymer resulting can be substituted with the appropriate alkyl, aryl lithium or Grignard reagent, aryl or alkyl alkoxy metal salt, or a number of amino pendant groups.

Several other possible routes to polyphosphazenes exist, including those described by Harry Allcock of Penn State University, Krzysztof Matyjaszewski of Carnegie Mellon University, Patty Wisian-Neilson of Southern Methodist University and Robert Neilson of Texas Christian University.

SYNTHETIC EXAMPLE III

Synthesis of Conductive Polysiloxanes

Synthesis of poly[bis(2-(2-(2-methoxyethoxy)ethoxy)-ethoxy) propylsiloxane] 21, reference West et al., *Organometallics*, 17, 1999, 3249, the disclosure of which is totally incorporated herein by reference, for use as blends or additives in carrier coatings can be prepared as follows.

The siloxane polymer, 21, is prepared by the addition of dichlorosilane (40 grams, 0.1 mol solution in xylene) to a solution containing triethylene glycol allyl methyl ether (41.12 grams, 0.2 mol) and a THF solution of chloroplatinic acid (20 mol) at 0° C. The resulting mixture is heated at 60° C. for 12 hours, after which the above solvents were removed to reveal a dark brown oil, which is redissolved in dichloromethane and precipitated into hexanes resulting in an 80 percent yield of the above polymer and a slightly colored oil.

SYNTHETIC EXAMPLE IV

Synthesis of the single combined polymer, poly[methyl (2-(2-(2-methoxyethoxy)ethoxy)-ethoxy) propyl alkyl siloxane], reference West et al., *Organometallics*, 17, 1999, 3249, the disclosure of which is totally incorporated herein by reference, for use as blends or additives in carrier coatings can be prepared as follows.

The single combined siloxane polymer, 22, is prepared by the addition of poly(methylhydrosiloxane) (40 grams, 0.67 mol solution in xylene) to a solution containing heptaethylene glycol allyl methyl ether (237.6 grams, 6.6 mol) and a THF solution of chloroplatinic acid (660 mol) at 0° C. The resulting mixture is heated at 60° C. and refluxed for 12 hours, after which time the above solvents were removed in vacuo. The polymer resulting was further purified by rinsing repeatedly in hexanes. The above polymer as a clear oil is recovered in a 95 percent yield.

EXAMPLE I

Melt Preparation of Polyphosphazene Homopolymer Carrier

A carrier coated with poly(phenylamino (methoxyethoxyethoxy) phosphazene (7) was prepared as follows.

In the first step of the carrier coating process, 3 grams of poly(phenylamino(methoxyethoxyethoxy) phosphazene homopolymer (7) as prepared in either Synthetic Example I or Synthetic Example II and 190 grams of 77 micron volume median diameter irregular steel core (obtained from Hoeganaes), with the core size determined in this and all carrier Examples by a standard laser diffraction technique, were mixed in a 250 milliliter plastic bottle. The mixing was accomplished with a hand shaker for a period of 45 minutes. There resulted uniformly distributed and electrostatically attached the above polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of the above steel carrier core with a total of approximately 90 percent surface coverage of the carrier core by the polymer, with the weight percent of the poly(phenylamino(methoxyethoxyethoxy) phosphazene (7) as determined in this and all carrier Examples by dividing the difference between the weights of the fused carrier and the carrier core by the weight of the fused carrier.

A developer composition was then prepared by mixing 200 grams of the above prepared coated carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 percent RH (relative humidity). The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE II

Solution Preparation of Polyphosphazene Homopolymer Carrier

A carrier coated with poly(phenylamino (methoxyethoxyethoxy) phosphazene (7) was prepared as follows.

In the first step of the carrier coating process, 3 grams of poly(phenylamino(methoxyethoxyethoxy) phosphazene homopolymer (7) prepared as in either Synthetic Example I or Synthetic Example II and 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core by the polymer, with the weight percent of the poly(phenylamino methoxyethoxyethoxy) phosphazene (7) as determined by dividing the difference between the weights of the fused carrier and the carrier core by the weight of the fused carrier.

A developer composition was then prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge, about a positive 35 microcoulombs per gram, on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE III

Melt Preparation of Polyphosphazene Homopolymer Carrier

A carrier coated with poly(bis[1,1 ]biphenyl-4-methoxy-4'-ethoxyethoxyethoxy) phosphazene (14) was prepared as follows.

In the first step of the carrier coating process, 3 grams of poly(bis[1,1]biphenyl-4-methoxy-4'-ethoxyethoxyethoxy) phosphazene homopolymer (14) prepared, for example, as in either Synthetic Example I or Synthetic Example II and 190 grams of 77 micron volume median diameter irregular steel core (obtained from Hoeganaes), with the core size being determined by a standard laser diffraction technique, were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier core by the polymer, with the weight percent of the poly (bis[1,1]biphenyl-4-methoxy-4'-ethoxyethoxyethoxy) phosphazene homopolymer (14).

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE IV

Solution Preparation of Polyphosphazene Homopolymer Carrier

A carrier coated with poly(bis[1,1]biphenyl-4-methoxy-4'-ethoxyethoxyethoxy) phosphazene (14) was prepared as follows:

In the first step of the. carrier coating process, 3 grams of a carrier coated as prepared in either Synthetic Example I or Synthetic Example II and 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich), were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core by the polymer, with the weight percent of the poly(bis[1,1]biphenyl-4-methoxy-4'-ethoxyethoxyethoxy) phosphazene (14).

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE V

Melt Preparation of Blended Polyphosphazene/ PMMA Polymer Carrier

A carrier coated with 50:50 poly(bis[1,1]biphenyl-4-methoxy-4'-ethoxyethoxyethoxy) phosphazene (14) polymethylmethacrylate was prepared as follows.

In the first step of the carrier coating process, 1.5 grams of poly(bis[1,1]biphenyl-4-methoxy-4'-ethoxyethoxyethoxy) phosphazene homopolymer (14) as prepared in either Synthetic Example I or Synthetic Example II and 1.5 grams of polymethylmethacrylate polymer with 190 grams of 77 micron volume median diameter irregular steel core (obtained from Hoeganaes), with the core size determined by a standard laser diffraction technique were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier core by the polymer, with the weight percent of the blended polymers, poly(bis[1,1]biphenyl-4-methoxy-4'-ethoxyethoxyethoxy) phosphazene homopolymer (14) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE VI

Solution Preparation of Blended Polyphosphazene/ PMMA Polymer Carrier

A carrier coated with a blend of poly(bis[1,1]biphenyl-4-methoxy-4'-ethoxyethoxyethoxy) phosphazene (14) and polymethyl methacrylate was prepared as follows.

In the first step of the carrier coating process, 1.5 grams of poly(bis[1,1]biphenyl-4-methoxy-4'-ethoxyethoxyethoxy) phosphazene homopolymer (14) as prepared in either Synthetic Example I or Synthetic Example II and 1.5 grams of polymethylmethacrylate polymer with 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core by the polymer, with the weight percent of the blended polymers, poly(bis[1,1]biphenyl-4-methoxy-4'-ethoxyethoxyethoxy) phosphazene (14) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be. determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE VII

Melt Preparation of Blended Polyphosphazene/ PMMA Polymer Carrier

A carrier coated with 50:50 of poly(bis-β-trifluoromethylethoxy)phosphazene (12)/ polymethylmethacrylate (PMMA) was prepared as follows.

In the first step of the carrier coating process, 1.5 grams of poly(bis-β-trifluoromethylethoxy)phosphazene (12) as prepared in either Synthetic Example I or Synthetic Example II and 1.5 grams of polymethylmethacrylate polymer along with 190 grams of 77 micron volume median diameter irregular steel core (obtained from Hoeganaes), with the core size determined in this and all following carrier examples by a standard laser diffraction technique were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier core by the polymer, with the weight percent of the blended polymers, of poly(bis-β-trifluoromethylethoxy)phosphazene (12) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge, about 30 to about 40 microns per gram is believed obtained, on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE VIII

Solution Preparation of Blended Polyphosphazene/ PMMA Polymer Carrier

A carrier coated with a blend of poly(bis-β-trifluoromethylethoxy)phosphazene (12) and polymethylmethacrylate was prepared as follows.

In the first step of the carrier coating process, 1.5 grams of poly(bis-β-trifluoromethylethoxy)phosphazene (12) as prepared in either Synthetic Example I or Synthetic Example II and 1.5 grams of polymethylmethacrylate polymer along with 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core by the polymer of poly(bis-β-trifluoromethylethoxy)phosphazene (12) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is to be $10^{-6}$ to $10^{-8}$ (mho-cm)$^{-1}$. Therefore, these carrier particles would be considered conductive.

EXAMPLE IX

Melt Preparation of Polyphosphazene Additive in a PMMA Polymer Carrier

A carrier coated with 3:97 ratio of poly(bis (methoxyethoxy ethoxy)phosphazene (1)/ polymethylmethacrylate was prepared as follows.

In the first step of the carrier coating process, 0.09 gram of poly(bis(methoxyethoxyethoxy)phosphazene (1) as prepared in either Synthetic Example I or Synthetic Example II and 2.91 grams of polymethylmethacrylate polymer with 190 grams of 77 micron volume median diameter irregular steel core (obtained from Hoeganaes), with the core size determined in this and all following carrier Examples by a standard laser diffraction technique were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier co re by the polymers of poly(bis (methoxyethoxyethoxy)phosphazene) (1) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ (mho-cm)$^{-1}$. Therefore, these carrier particles would be considered conductive.

EXAMPLE X

Solution Preparation of Polyphosphazene Additive in a PMMA Polymer Carrier

A carrier coated with 3:97 ratio of poly(bis (methoxyethoxyethoxy) phosphazene (1)/ polymethylmethacrylate was prepared as follows.

In the first step of the carrier coating process, 0.09 gram of poly(bis(methoxyethoxyethoxy)phosphazene (1) as prepared in either Synthetic Example I or Synthetic Example II and 2.91 grams of polymethylmethacrylate polymer together with 190 grams of 77 micron volume median diameter irregular steel core (obtained from Hoeganaes), with the core size determined by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of the above carrier core with a total of approximately 90 percent surface coverage of the carrier core by the above polymers, with the weight percent of the blended polymers, of poly (bis(methoxyethoxyethoxy)phosphazene (1) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-7}$ (mho-cm)$^{-1}$. Therefore, these carrier particles would be considered conductive.

EXAMPLE XI

Melt Preparation of Blended Polyheterophosphazene/PMMA Polymer Carrier

A carrier coated with 50:50 mixture by weight percent of poly(2-methoxyethoxyethoxycarbo-4,4-methoxyethoxyethoxy-6,6-methoxyethoxy ethoxy) phosphazene (17)/polymethylmethacrylate was prepared as follows.

In the first step of the carrier coating process, 1.5 grams of poly(2-methoxyethoxyethoxycarbo-4,4-methoxyethoxyethoxy-6,6-methoxy ethoxyethoxy) phosphazene (17) prepared by ring-opening polymerization reactions of the parent inorganic ring molecule under conditions similar to those in Synthetic Example I and 1.5 grams of polymethylmethacrylate polymer together with 190 grams of 77 micron volume median diameter irregular steel core (obtained from Hoeganaes), with the core size determined by a standard laser diffraction technique were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of the above carrier core with a total of approximately 92 percent surface coverage of the carrier core by above polymers with the weight percent of the blended polymers, of poly(2-methoxyethoxyethoxycarbo-4,4-methoxyethoxyethoxy-6,6-methoxyethoxy ethoxy) phosphazene (17) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-8}$ (mho-cm)$^{-1}$. Therefore, these carrier particles would be considered conductive.

EXAMPLE XII

Solution Preparation of Blended Heteropolyphosphazene/PMMA Polymer Carrier

A carrier coated with a blend of poly(2-methoxyethoxyethoxycarbo-4,4-methoxyethoxyethoxy-6,6-methoxyethoxy ethoxy) phosphazene (17) and polymethylmethacrylate was prepared as follows.

In the first step of the carrier coating process, 1.5 grams of poly(2-methoxyethoxyethoxycarbo-4,4-methoxyethoxyethoxy-6,6-methoxy ethoxyethoxy) phosphazene (17) prepared by the ring-opening polymerization reaction of the parent inorganic ring molecule under conditions similar to those in Synthetic Example I and 1.5 grams of polymethylmethacrylate polymer together with 190 grams of 77 micron volume median diameter irregular steel core (obtained from Hoeganaes), with the core size determined by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core of the polymer mixture, of poly(2-methoxyethoxyethoxycarbo-4,4-methoxyethoxyethoxy-6,6-methoxy ethoxyethoxy) phosphazene (17) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ (mho-cm)$^{-1}$. Therefore, these carrier particles would be considered conductive.

EXAMPLE XIII

Melt Preparation of Polyheterophosphazenene Additive in a PMMA Polymer Carrier A carrier coated with 3:97 ratio of poly(2-methoxyethoxyethoxycarbo-4,4-methoxyethoxyethoxy-6,6-methoxyethoxy ethoxy) phosphazene (17)/polymethylmethacrylate was prepared as follows.

In the first step of the carrier coating process, 0.09 gram of poly(2-methoxyethoxyethoxycarbo-4,4-methoxyethoxyethoxy-6,6-methoxy ethoxyethoxy) phosphazene (17) prepared by ring-opening polymerization reaction of the parent inorganic ring molecule under conditions similar to those in Synthetic Example I and 2.91 grams of polymethylmethacrylate polymer together with 190 grams of 77 micron volume median diameter irregular steel core (obtained from Hoeganaes), with the core size determined by a standard laser diffraction technique were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier core of the above polymers, with the weight percent of the blended polymers, of poly(2-methoxyethoxyethoxycarbo-4,4-methoxyethoxyethoxy-6,6-methoxyethoxyethoxy) phosphazene (17) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-7}$ (mho-cm)$^{-1}$. Therefore, these carrier particles would be considered conductive.

EXAMPLE XIV

Solution Preparation of Heteropolyphosphazene Additive in a PMMA Polymer Carrier A carrier coated with a 3:97 ratio of poly(2-methoxyethoxyethoxycarbo-4,4-methoxyethoxyethoxy-6,6-methoxyethoxy ethoxy) phosphazene (17) and polymethylmethacrylate was prepared as follows.

In the first step of the carrier coating process, 0.09 gram of poly(2-methoxyethoxyethoxycarbo-4,4-methoxyethoxyethoxy-6,6-methoxy ethoxyethoxy) phosphazene (17) prepared by ring-opening polymerization reaction of the parent inorganic ring molecule under conditions similar to those in Synthetic Example I and 2.91 grams of polymethylmethacrylate polymer with 190 grams of 77 micron volume median diameter irregular steel core (obtained from Hoeganaes), with the core size determined in this and all following carrier Examples by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating mixture on the core. The final product was comprised of a carrier core with a total of approximately 90 percent surface coverage of the carrier core with the above polymer mixture, with the weight percent of the blended polymers, of poly(2-methoxyethoxyethoxy-carbo-4,4-methoxyethoxyethoxy-6,6-methoxyethoxy ethoxy) phosphazene (17), and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-7}$ (mho-cm)$^{-1}$. Therefore, these carrier particles would be considered conductive.

EXAMPLE XV

Melt Preparation of Blended Polysiloxane/PMMA Polymer Carrier

A carrier coated with 50:50 of poly[bis(2-(2-(2-methoxyethoxy)ethoxy)-ethoxy) propylsiloxane] (21)/polymethylmethacrylate was prepared as follows.

In the first step of the carrier coating process, 1.5 grams of poly[bis(2-(2-(2-methoxyethoxy)ethoxy)-ethoxy) propylsiloxane] (21) prepared as in Synthetic Example III and 1.5 grams of polymethylmethacrylate polymer along with 190 grams of 77 micron volume median diameter irregular steel core (obtained from Hoeganaes), with the core size determined by a standard laser diffraction technique, were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a. period of 30 minutes at a temperature of 205° C., thereby causing the polymer to melt and fuse to the core. This resulted in a continuous uniform polymer mixture coating on the core. The final product was comprised of a carrier core with a total of approximately 90 percent surface coverage of the carrier core of the above polymers, with the weight percent of the blended polymers, of poly[bis(2-(2-(2-methoxyethoxy) ethoxy)-ethoxy) propylsiloxane] 21 and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content, obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be about $10^{-6}$ to $10^{-8}$ $(\text{mho-cm})^{-1}$. Therefore, these carrier particles would be considered conductive.

EXAMPLE XVI

Solution Preparation of Blended Polysiloxane/ PMMA Polymer Carrier

A carrier coated with a blend of poly[bis(2-(2-(2-methoxyethoxy)ethoxy)-ethoxy) propylsiloxane] (21), and polymethylmethacrylate was prepared as follows.

In the first step of the carrier coating process, 1.5 grams of poly[bis(2-(2-(2-methoxyethoxy)ethoxy)-ethoxy) propylsiloxane] (21), prepared as in Synthetic Example III and 1.5 grams of polymethylmethacrylate polymer with 190 grams of 77 micron volume median diameter irregular steel core (obtained from Hoeganaes), with the core size determined by a standard laser diffraction technique and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the dichloromethane mixture containing the polymer and the carrier beads, with continuous air stirring, were brought to dryness by vacuum evaporation. This resulted in a continuous uniform polymer coating on the core. The final product was comprised of a carrier core with a total of approximately 90 percent surface coverage of the carrier core of the above polymers, with the weight percent of the blended polymers, of poly[bis(2-(2-(2-methoxyethoxy)ethoxy)-ethoxy) propylsiloxane] (21), and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 to 60 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-8}$ $(\text{mho-cm})^{-1}$. Therefore, these carrier particles would be considered conductive.

EXAMPLE XVII

Melt Preparation of Polysiloxane Additive in a PMMA Polymer Carrier

A carrier coated with 3:97 ratio of poly[bis(2-(2-(2-methoxyethoxy)ethoxy)-ethoxy) propylsiloxane] (21)/ polymethylmethacrylate was prepared as follows:

In the first step of the carrier coating process, 0.09 gram of poly[bis(2-(2-(2-methoxyethoxy)ethoxy)-ethoxy) propylsiloxane] (21) prepared as in Synthetic Example III and 2.91 grams of polymethylmethacrylate polymer along with 190 grams of 77 micron volume median diameter irregular steel core (obtained from Hoeganaes), with the core size being determined by a standard laser diffraction technique, were mixed in a 250 milliliter plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of approximately 90 percent surface coverage of the carrier core of the above polymers, with the weight percent of the blended polymers, of poly[bis(2-(2-(2-methoxyethoxy)ethoxy)-ethoxy) propylsiloxane] 21 and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be $10^{-6}$ to $10^{-8}$ $(\text{mho-cm})^{-1}$. Therefore, these carrier particles would be considered conductive.

EXAMPLE XVIII

Solution Preparation of Polysiloxane Additive in a PMMA Polymer Carrier

A carrier coated with 3:97 ratio of poly[bis(2-(2-(2-methoxyethoxy)ethoxy)-ethoxy) propylsiloxane] (21)/ polymethylmethacrylate was prepared as follows.

In the first step of the carrier coating process, 0.09 gram of poly[bis(2-(2-(2-methoxyethoxy)ethoxy)-ethoxy) propylsiloxane] (21) prepared as in Synthetic Example III and 2.91 grams of polymethylmethacrylate polymer along with 190 grams of 77 micron volume median diameter irregular steel core (obtained from Hoeganaes), with the core size being determined by a standard laser diffraction technique, and 100 milliliters of ACS grade dichloromethane (Aldrich) were mixed in a 250 milliliter plastic bottle. The mixing was accomplished with a hand shaker for a period of 45 minutes. There resulted a uniform distribution of the attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core, 93 percent surface coverage of the above polymers, with the weight percent of the blended polymers, of poly[bis(2-(2-(2-methoxyethoxy) ethoxy)-ethoxy) propylsiloxane] (21) and polymethylmethacrylate calculated as in carrier coating Example I.

A developer composition can then be prepared by mixing 200 grams of the above prepared carrier with 8 grams of a 7 micron volume median diameter (volume average diameter) toner composition comprised of a partially crosslinked polyester resin with 7 percent (by weight) gel content obtained by the reactive extrusion of a linear bisphenol A propylene oxide fumarate polymer. This developer can be further conditioned for 18 hours at 50 percent RH. The resulting developer was shaken on a paint shaker, and 0.3 gram samples were removed after 1 minute, 15 minutes, and 90 minutes. Thereafter at each of these mixing times, the triboelectric charge on the carrier particles can be determined by the known Faraday Cage process. Further, the conductivity of the carrier as determined by forming a 0.1 inch long magnetic brush of the carrier particles, and measuring the conductivity by imposing a 10 volt potential across the brush is expected to be about $10^{-7}$ (mho-cm)$^{-1}$. Therefore, these carrier particles would be considered conductive.

OTHER EXAMPLES

Comparative Example I

One gram of PMMA (polymethylmethacrylate) polymer containing 18 weight percent of carbon black was dissolved in a solvent of tetrahydrofuran (THF), 50 grams of solvent. One hundred grams of nuclear metals, 100 micron diameter carrier core particles, were preheated in an oven to about 125° C. The above polymer solution was then added to the hot core with stirring. The resulting mixture was then dispersed on a tray and dried in vacuum overnight, about 18 hours.

A xerographic developer composition was then prepared by adding 1 gram of a 9 micron volume median diameter toner composition to the above coated carrier. The toner composition was comprised of a 30 percent by weight gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer and pigment of 0.4 weight percent REGAL 330® carbon black obtained from Cabot Inc. and TS530, an external silica additive. The developer composition was then conditioned overnight at 50 percent relative humidity, and was subsequently charged on a paint shaker. The carrier charge was determined after 15 minutes and after 90 minutes of charging to primarily determine the stability of the charge to very aggressive mixing using the known Faraday Cage process. There was measured on the carrier a positive charge of 14.7 microcoulombs per gram after 15 minutes of mixing and 13.9 microcoulombs per gram after 90 minutes of mixing. Further, the conductivity of the carrier as determined by forming a 0.1 inch long magnetic brush off carrier particles, and measuring the conductivity by imposing a 10 volt potential across the brush was $2.3\times10^{-9}$ (ohm-cm)$^{-1}$.

Example II

One gram of a poly(ferrocenyl dimethylsilane), [Fc—Si $(CH_3)_2$], with an $M_n$ and $M_w$ of greater than about $>10^5$, like $10^6$, and which dimethylsilane was obtained from Professor Ian Manners, Department of Chemistry, University of Toronto, was dissolved in about 50 grams of THF of solvent. One hundred grams of nuclear metals, 100 micron diameter carrier core particles, were preheated in an oven to 125° C. The above prepared polymer solution was then added to the above hot core with stirring. The mixture was then dispersed on a metal tray and dried in vacuum overnight.

A xerographic developer composition was then prepared and charged as described in Comparative Example I, producing a positive carrier charge of 14.2 microcoulombs per gram after 15 minutes of mixing and 13.2 microcoulombs per gram after 90 minutes of mixing. Further, the conductivity of the carrier was measured as $3.5\times10^{-9}$ (ohm-cm)$^{-1}$. Thus, Example II illustrates that substantially the same charge and conductivity can be obtained as for the reference coating material without the addition of an additional conductive additive, such as carbon black, that was used in Comparative Example I.

Example III

Polyferrocenysilane/Polysiloxane Coating Blend

Seven-tenths of a gram of poly(ferrocenyl dimethylsilane), [Fc—Si$(CH_3)_2$], obtained from Professor Ian Manners, Department of Chemistry, University of Toronto, and 0.3 gram of polysiloxane (21) were dissolved in about 25 grams of THF solvent. One hundred grams of nuclear metals, 90 micron carrier core particles, were preheated in an oven to 125° C. The above polymer solution was then added to the hot core with stirring. The mixture was then dispersed on a metal tray and dried in vacuum overnight.

A xerographic developer composition was then prepared and charged as described in Comparative Example I, resulting in a carrier positive charge of 26.3 microcoulombs per gram after 15 minutes of mixing and 14.2 microcoulombs per gram after 90 minutes of mixing. Further, the conductivity of the carrier was measured as $5\times10^{-11}$ (ohm-cm)$^{-1}$. Thus, Example III illustrates that with the inventive polymer blend composition as a carrier coating material, substantially higher initial charge can be obtained and somewhat lower conductivity can be obtained compared to the reference coating material without the addition of an additional conductive additive, such as carbon black, used in Comparative Example I.

Example IV

Polyferrocenysilane/Polyphosphazene Carrier Coating Blend

Seven-tenths of a gram of poly(ferrocenyl dimethylsilane), [Fc—Si$(CH_3)_2$], obtained from Professor Ian Manners, Department of Chemistry, University of Toronto, and 0.3 gram of polyphosphazene (1), were dissolved in about 25 grams of THF solvent. One hundred grams of nuclear metals, 90 micron carrier core particles, were preheated in an oven to 125° C. The above blended polymer solution was then added to the hot core with stirring. The mixture was then dispersed on a metal tray and dried in vacuum overnight resulting in a carrier of the above core coated with the above polymer-blend.

A xerographic developer composition was then prepared and charged as described in Comparative Example I resulting in a carrier positive charge of 16.63 microcoulombs per gram after 15 minutes of mixing and 14.1 microcoulombs per gram after 90 minutes of mixing. Further, the conductivity of this coated carrier was measured as $2.1\times10^{-12}$ (ohm-cm)$^{-1}$.

Example V

Polyferrocenysilane/Polyphosphazene Carrier Coating Blend

Seven-tenths of a gram of poly(ferrocenyl dimethylsilane), [Fc—Si$(CH_3)_2$], obtained from Professor Ian Manners, Department of Chemistry, University of Toronto, and 0.3 gram of polyphosphazene (14), were dissolved in THF, about 25 grams of solvent. One hundred grams of nuclear metals, 90 micron carrier core particles, were preheated in an oven to 125° C. The above polymer solution was then added to the hot core with stirring about 18 to 20 hours. The mixture was then dispersed on a metal tray and dried in vacuum overnight to provide carrier particles comprised of the above core and polymer coating mixture.

A xerographic developer composition was then prepared and charged as described in Comparative Example I resulting in a carrier positive charge of 15.8 microcoulombs per gram after 15 minutes of mixing and 13.9 microcoulombs per gram after 90 minutes of mixing. Further, the conductivity of this carrier was measured as $4.9\times10^{-10}$ (ohm-cm)$^{-1}$.

Example VI

Polyferrocenysilane/Polysiloxane Copolymer

One gram of poly(ferrocenyl dimethylsilane), and one gram of [Fc–Si$(CH_3)_2$]/polysiloxane copolymer, obtained from Professor Ian Manners, Department of Chemistry, University of Toronto, were dissolved in THF, about 25 grams of solvent. One hundred grams of nuclear metals, 90 micron carrier core particles, were preheated in an oven to 125° C. The polymer solution was then added to the hot core with stirring. The mixture was then dispersed on a metal tray and dried in vacuum overnight to provide carrier particles comprised of the above core and polymer coating mixture.

A xerographic developer composition was then prepared and charged as described in Comparative Example I resulting in a carrier positive charge of 18.9 microcoulombs per gram after 15 minutes of mixing and 14.8 microcoulombs per gram after 90 minutes of mixing. Further, the conductivity of this carrier was measured as 1.4×10–11 (ohm-cm)$^{1}$.

Example VII

Polyferrocenysilane-Polysiloxane Copolymer

One gram of poly(ferrocenyl dimethylsilane)/polysiloxane copolymer [Fc—Si$(CH_3)_2]_n$—$\{Me_2SiO\}_m$, obtained from Professor Ian Manners, Department of Chemistry, University of Toronto, were dissolved in THF, about 25 grams of solvent. One hundred grams of nuclear metals, 90 micron carrier core particles, were preheated in an oven to 125° C. The polymer solution was then added to the hot core with stirring. The mixture was then dispersed on a metal tray and dried in vacuum overnight to provide carrier particles comprised of the above core and polymer coating mixture.

A xerographic developer composition was then prepared and charged as described in Comparative Example I resulting in a carrier positive charge of 22.4 microcoulombs per gram after 15 minutes of mixing and 15.6 microcoulombs per gram after 90 minutes of mixing. Further, the conductivity of the carrier was measured as $9.7\times10^{-10}$ (ohm-cm)$^{-1}$.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A carrier comprised of a core and thereover a polymer, and which polymer contains dispersed therein a mixture of an inorganic polymer, and an organic metallic polymer.

2. A carrier comprised of a core and thereover a polymer, and which polymer contains dispersed therein as a conductive additive an inorganic metallic polymer.

3. A carrier comprised of a core and thereover a polymer, and which polymer contains dispersed therein as a conductive additive an organic metallic polymer.

4. A carrier in accordance with claim 1 with from about 1 to about 99 weight percent of said inorganic polymer and from about 99 to about 1 weight percent of said organic metallic polymer, and wherein the total thereof is about 100 percent.

5. A carrier in accordance with claim 1 with from about 40 to about 60 weight percent of said inorganic polymer and from about 60 to about 40 weight percent of said organic metallic polymer, and wherein the total thereof is about 100 percent.

6. A carrier in accordance with claim 1 wherein said inorganic polymer is a metallic polymer, and said metal for said inorganic polymer is iron, or Fe.

7. A carrier in accordance with claim 1 wherein said metal for said organic polymer is iron, and said polymer is a styrene acrylate, a styrene methacrylate, or mixtures thereof.

8. A carrier in accordance with claim 1 wherein said inorganic polymer and said organic metallic polymer are semitransparent, or substantially colorless.

9. A carrier in accordance with claim 1 wherein the polymer coating weight thereof is from about 0.1 to about 20 weight percent.

10. A carrier in accordance with claim 1 wherein the polymer coating weight is from about 1 to about 3 weight percent; wherein the polymer coating possesses a glass transition temperature Tg of from about 120° C. to about 200° C.; and a triboelectric charge of from about a positive 25 to about a positive 70 microcoulombs per gram.

11. A carrier in accordance with claim 1 wherein said core is a metal, a metal oxide, or a ferrite.

12. A developer comprised of the carrier of claim 1 and toner.

13. A developer in accordance with claim 12 wherein the toner is comprised of thermoplastic resin and colorant.

14. A developer in accordance with claim 12 wherein the colorant is a pigment and the resin is a styrene copolymer, or a polyester.

15. A developer comprised of a (1) carrier core, thereover a polymer or polymers layer; (2) dispersed therein as a conductive additive an inorganic polymer, an organic metallic polymer, or optionally mixtures thereof, and (3) a toner.

16. A developer in accordance with claim 15 wherein the carrier core is selected from the group consisting of iron, ferrites, steel and nickel.

17. A carrier in accordance with claim 1 wherein said carrier possesses a conductivity of from about $1\times10^{-5}$ to about $1\times10^{-9}$.

18. A carrier in accordance with claim 1 wherein the carrier contains an additional polymer coating.

19. A carrier in accordance with claim 18 wherein the additional coating is comprised of a styrene acrylate, a styrene methacrylate, or a fluoropolymer.

20. A carrier in accordance with claim 19 wherein said additional coating is comprised of a polyurethane, and which polyurethane optionally contains dispersed therein conductive components.

21. A carrier in accordance with claim 19 wherein the additional coating is comprised of a polyurethane/polyester.

22. An imaging process which comprises developing an image with the developer of claim 12.

23. A process for the preparation of the carrier of claim 1 by the dry mixing and heating of said core, said polymer coating and said additives.

24. A carrier in accordance with claim 1 wherein the core is powdered steel, or wherein the core is a strontium ferrite.

25. A carrier in accordance with claim 1 wherein the carrier is of an average diameter of from about 50 to about 125 microns, and said polymer is polymethylmethacrylate.

26. A carrier in accordance with claim 1 wherein inorganic or organic polymer is present in an amount of from about 1 to about 60 weight percent, said polymer is present in an amount of from about 20 to about 50 weight percent, or said polymer is present in an amount of from about 30 to about 45 weight percent.

27. A carrier in accordance with claim 1 wherein said inorganic polymer is a polyphosphazene, and said organic metallic polymer is a ferrocene.

28. A carrier in accordance with claim 1 wherein said inorganic polymer is a polyphosphazene of poly(bis (methoxyethoxyethoxy) phosphazene (1); poly(phenyl (methoxy ethoxyethoxy)phosphazene (2); poly(methyl (methoxy ethoxyethoxy) phosphazene (3); poly(methoxy (methoxyethoxyethoxy) phosphazene (4); poly(phenoxy (methoxyethoxy ethoxy)phosphazene (5); poly (methylamino (methoxyethoxyethoxy) phosphazene (6); poly(phenylamino (methoxyethoxyethoxy) phosphazene (7); poly(bis(methoxyethoxy) phosphazene (8); poly(bis (methoxypropoxy) phosphazene (9); poly(bis-β-pentafluroethylpropoxy) phosphazene (10); poly (bisphenoxy) phosphazene (11); poly(bis-β-trifluoromethylethoxy) phosphazene (12); poly(bis-4-phenylphenoxy) phosphazene (13); poly(bis[1,1]biphenyl-4-methoxy-4'-ethoxyethoxyethoxy) phosphazene (14); or poly(bismethoxy) phosphazene (15); a carrier wherein the conductive polymer is a polyphosphazene of poly[bis-4-isopropylphenoxy)phosphazene] (16); poly(2-methoxyethoxy ethoxycarbo-4,4-methoxyethoxyethoxy-6,6-methoxyethoxyethoxy) phosphazene (17); poly(2-methoxyethoxyethoxy-thio-4,4-methoxy ethoxyethoxy-6,6-methoxy ethoxyethoxy) phosphazene (18); poly(2-methoxyethoxyethoxycarbo-4,4-methoxyethoxyethoxy-6,6-methoxy ethoxyethoxy) phosphazene (19); (poly (methoxyethoxyethoxy)oxothiazene (20); a polysiloxane of poly[(2-(2-(2-methoxyethoxy)ethoxy)-ethoxy)propyl alkyl siloxane] (21); poly[methyl(2-(2-(2-methoxyethoxy) ethoxy)-ethoxy)propyl alkyl siloxane] (22); poly[ethyl(2-(2-(2-methoxyethoxy)ethoxy)-ethoxy)propyl alkyl siloxane] (23); poly[propyl(2-(2-(2-methoxyethoxy)ethoxy)-ethoxy) propyl alkyl siloxane] (24); poly[phenyl(2-(2-(2-methoxyethoxy)ethoxy)-ethoxy)propyl alkyl siloxane] (25); and said organic polymer is a ferrocene.

29. A carrier comprised of a core and thereover at least two polymers and wherein the polymer on the exposed surface of the carrier contains dispersed therein a mixture of an inorganic polymer and an organic metallic polymer.

30. A carrier in accordance with claim 29 wherein at least two is from about 2 to about 4.

31. A carrier consisting of a core and thereover at least two polymers, and wherein the polymer on the exposed surface of the carrier contains dispersed therein a mixture of an inorganic polymer and an organic metallic polymer.

* * * * *